US007308728B2

(12) United States Patent
Haviv

(10) Patent No.: US 7,308,728 B2
(45) Date of Patent: Dec. 18, 2007

(54) TOILET CLEANING IMPLEMENT

(75) Inventor: Joseph Haviv, New York, NY (US)

(73) Assignee: The Evercare Company, Alpharetta, GA (US)

( * ) Notice: Subject to any disclaimer, the term of this patent is extended or adjusted under 35 U.S.C. 154(b) by 162 days.

(21) Appl. No.: 11/227,901

(22) Filed: Sep. 15, 2005

(65) Prior Publication Data

US 2007/0056127 A1 Mar. 15, 2007

(51) Int. Cl.
*A47K 11/10* (2006.01)

(52) U.S. Cl. ..... 15/105; 15/160; 4/255.11

(58) Field of Classification Search ..... 15/105, 15/160, 184; 4/255.11
See application file for complete search history.

(56) References Cited

U.S. PATENT DOCUMENTS

| | | | | |
|---|---|---|---|---|
| 1,595,726 | A * | 8/1926 | Pierce | 15/160 |
| 2,473,452 | A | 6/1949 | Scott | |
| 2,644,181 | A * | 7/1953 | Lazarus et al. | 15/105 |
| 3,031,683 | A | 5/1962 | Hellwig | |
| 4,174,548 | A | 11/1979 | Dunn | |
| 5,617,605 | A | 4/1997 | Hoerner et al. | |
| 6,393,626 | B1 | 5/2002 | Dhillon | |
| 6,804,839 | B1 | 10/2004 | McMaster | |
| 2004/0187241 | A1 * | 9/2004 | Katz et al. | 15/144.4 |
| 2005/0125922 | A1 | 6/2005 | Szarawarski | |
| 2006/0260077 | A1 * | 11/2006 | Wilson | 15/104.16 |

* cited by examiner

*Primary Examiner*—Randall Chin
(74) *Attorney, Agent, or Firm*—Gifford, Krass, Sprinkle, Anderson & Citkowski, P.C.

(57) ABSTRACT

A toilet cleaning implement having a plunger with an elongated handle and a compressible cup attached to one end of the handle. The cup defines a cavity open at one end. An elongated rod is longitudinally slidably mounted to the handle and movable between an extended position and a retracted position. A toilet cleaning brush is attached to one end of the handle so that, with the rod in its retracted position, the brush is nested within the cup cavity and with the rod in its extended position, the brush protrudes outwardly through the open end of the cup cavity.

13 Claims, 3 Drawing Sheets

TOILET CLEANING IMPLEMENT

BACKGROUND OF THE INVENTION

I. Field of the Invention

The present invention relates generally to cleaning implements and, more particularly, to a toilet cleaning implement.

II. Description of Related Art

The proper hygienic maintenance of a toilet has previously required two separate and distinct components. The first component is a plunger having an elongated handle and a compressible cup at one end. A plunger is employed to free any clogs in the waste pipe from the toilet by compressing the cup against the toilet outlet.

The second component for proper hygienic maintenance of a toilet comprises a toilet brush. The toilet brush is used to scour the interior of the toilet of debris, stains and the like in the toilet bowl.

A primary disadvantage of the previously known toilet cleaning implements is that each implement required its own separate storage. This is particularly disadvantageous for small bathrooms and lavatories where only minimal storage space is available.

SUMMARY OF THE PRESENT INVENTION

The present invention provides a toilet cleaning implement which overcomes all of the above-mentioned disadvantages of previously known devices.

In brief, the toilet cleaning implement of the present invention comprises a plunger having an elongated handle and a compressible cup attached to one end of the handle. The cup defines a cavity which is open at one end.

An elongated rod is slidably mounted to the handle and is movable between an extended and a retracted position. Preferably, an actuator button is attached to the rod and is slidably mounted within an elongated slot formed in the plunger handle. The coaction between the actuator button and the handle slot also prevents rotation of the rod relative to the handle.

A toilet cleaning brush is then attached to one end of the rod. When the rod is in its retracted position, the toilet cleaning brush is nested within the cup cavity of the plunger. Conversely, when the rod is moved to its extended position, the toilet cleaning brush protrudes outwardly from the open end of the cavity for use in cleaning the toilet bowl.

A primary advantage of the toilet cleaning implement of the present invention is that, with the rod in its retracted position, both the plunger and the toilet cleaning brush occupy the same space previously required by the plunger alone.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
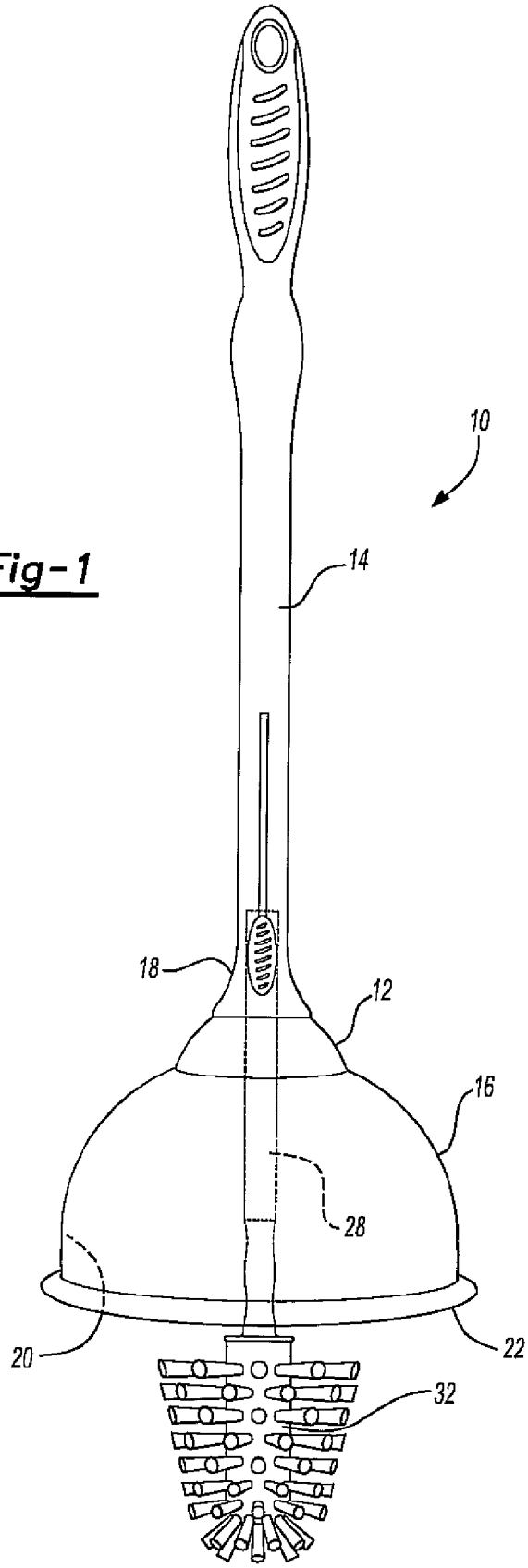
FIG. 1 is a side view of the preferred embodiment and illustrating the brush in an extended position.

With reference first to FIG. 1, a preferred embodiment of the toilet cleaning implement 10 of the present invention is shown and includes a plunger 12. The plunger 12 has an elongated handle 14 with a compressible cup 16 attached at one end 18 of the handle 14. The handle 14 may be constructed of any conventional material, such as a synthetic plastic material, and the compressible cup 16 is attached to the handle in any conventional fashion.

The cup 16 defines a cavity 20 open at one end 22. The open end 22 of the cavity 20, furthermore, faces outwardly from the end 18 of the plunger handle 14.

The plunger 12 is formed of any flexible and compressible material, such as synthetic rubber. Other materials may be used for the cup 16, however, without deviation from either the scope or spirit of the invention.

Figure 2:
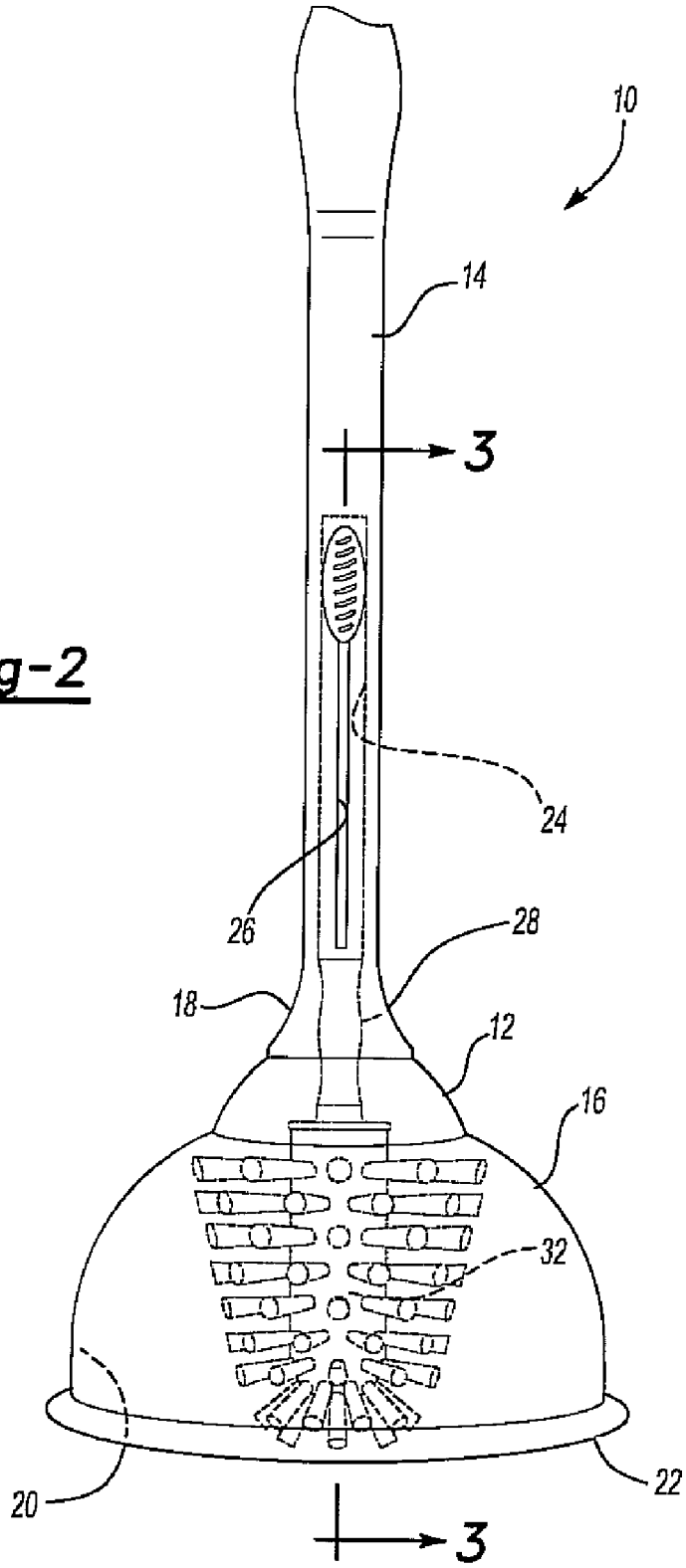
FIG. 2 is a view similar to FIG. 1, but illustrating the brush in a retracted position.
Figure 3:
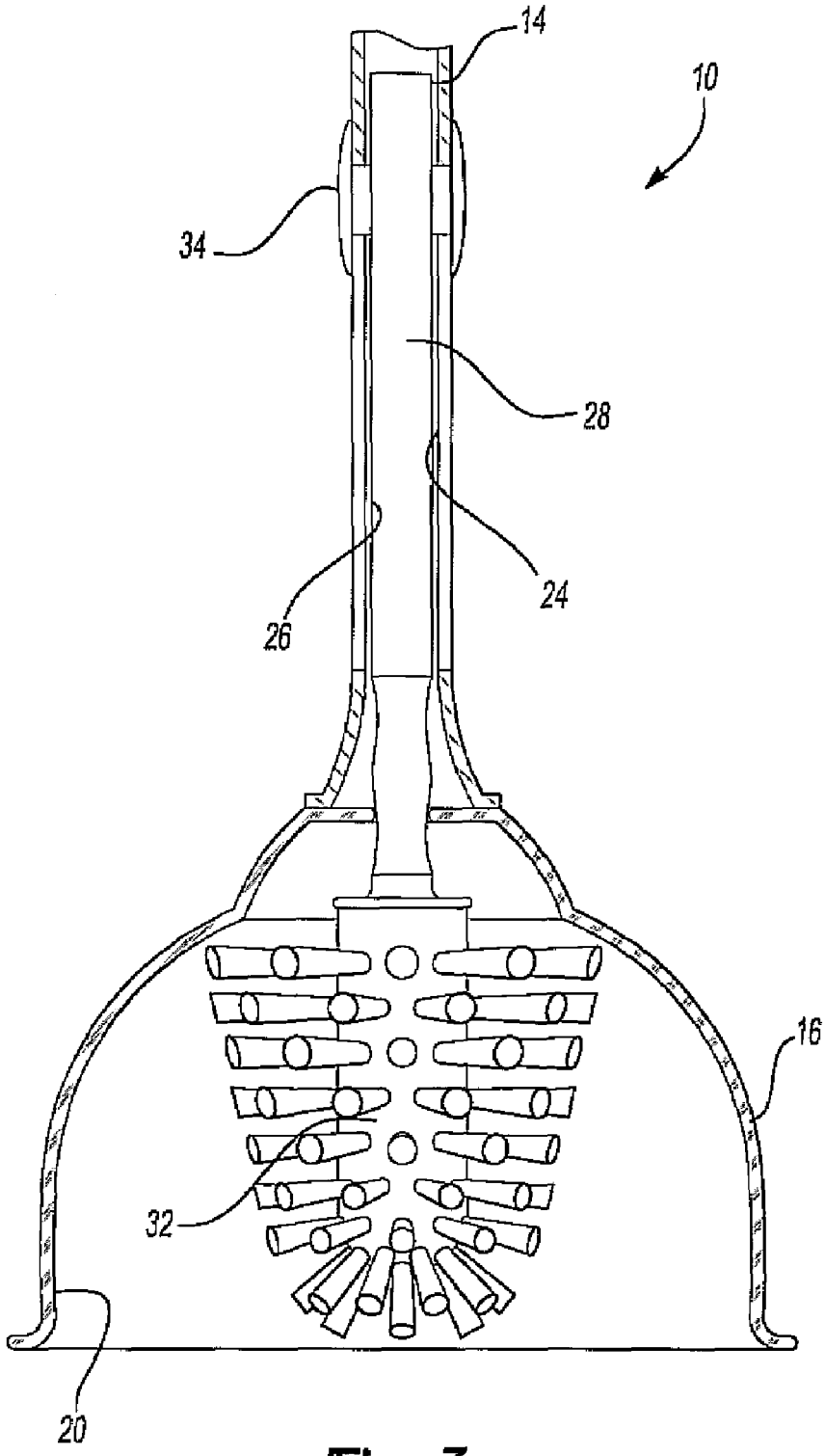
FIG. 3 is a sectional view taken along line 3-3 in FIG. 2.

With reference now particularly to FIG. 3, a longitudinally extending bore 24 is formed in the plunger handle 14 and one end of the bore 24 is open to the cup cavity 20. An elongated and longitudinally extending slot 26 (FIG. 2) is formed through the handle 12 and this slot 26 is open to the bore 24.

An elongated rod 28 is slidably mounted within the handle bore 24. One end 30 of the rod 28 protrudes into the cup cavity 20.

A toilet cleaning brush 32 is attached to the end 30 of the rod 28. The toilet cleaning brush 32 may be constructed of any suitable material, such as a synthetic plastic material.

The rod 28 with its attached brush 32 is movable between a retracted position, illustrated in FIG. 2, and an extended position, illustrated in FIG. 1. In its retracted position, the brush 32 is nested within the interior of the cavity 20. Conversely, with the rod 28 in its extended position, the brush 32 protrudes outwardly through the open end 22 of the plunger cup 16.

With reference now particularly to FIG. 3, in order to facilitate the movement of the rod 28 between its retracted and extended positions, an actuator button 34 is fixedly attached to the rod 28. The actuator button 34 is slidably mounted within the handle slot 26 and protrudes outwardly from the slot 26 for easy access by the user exteriorly of the handle 12.

The actuator button 34 serves two distinct purposes. First, the actuator button 34 enables the rod 28 to be easily manually moved between its extended and its retracted position. Secondly, however, the actuator button 34 prevents rotation of the rod, and thus rotation of the brush 32, relative to the handle 12. Consequently, the brush 32 may be rotated in unison with the handle 12 for better cleaning action of the brush 32.

In operation, with the handle 28 and its attached brush 32 in its retracted position, the plunger 12 may be used, when required, in order to clear toilet clogs. Similarly, with the handle 28 and its attached brush 32 in the extended position, the handle 14 may be used to manipulate the brush 32 to clean a toilet bowl as required. Most importantly, however, with the handle 28 and brush 32 in their retracted position, the entire toilet cleaning implement 10 of the present invention provides compact storage of the implement 10 when not in use.

From the foregoing, it can be seen that the present invention provides a simple and yet highly effective toilet cleaning implement which overcomes the disadvantages of the previously known devices. Having described my invention, however, many modifications thereto will become apparent to those skilled in the art to which it pertains without deviation from the spirit of the invention as defined by the scope of the appended claims.

I claim:

1. A toilet cleaning implement comprising:

a plunger having an elongated handle and a compressible cup attached to one end of said handle, said cup defining a cavity open at one end, an elongated rod longitudinally slidably mounted to said handle and movable between an extended position and a retracted position, a toilet cleaning brush attached to one end of said rod, an actuator button attached to said rod, wherein with said rod in said retracted position, said brush is nested within said cup cavity and wherein with said rod in said extended position, said brush protrudes outwardly through said open end of said cup cavity, wherein said handle includes an elongated and longitudinally extending slot, and wherein said actuator button is slidably mounted in said handle slot.

2. The implement as defined in claim 1 wherein said brush is made of a synthetic material.

3. The implement as defined in claim 1 wherein said brush is locked against rotation relative to said handle.

4. The implement as defined in claim 1 and comprising means for preventing rotation of said brush relative to said handle.

5. The implement as defined in claim 4 wherein said preventing means comprises an actuator button attached to said rod, said actuator button being longitudinally slidably mounted in a longitudinal slot in said handle.

6. The implement as defined in claim 1 wherein said rod is slidably mounted in a longitudinal bore formed in said handle.

7. The implement as defined in claim 6 wherein said handle includes an elongated and longitudinally extending slot open to said bore and comprising an actuator button attached to said rod and slidably mounted in said slot.

8. The implement as defined in claim 7 wherein said actuator button extends outwardly from said slot.

9. The implement as defined in claim 7 wherein said actuator button is fixedly mounted to said rod.

10. A toilet cleaning implement comprising:

a plunger having an elongated handle and a compressible cup attached to one end of said handle, said cup defining a cavity open at one end, an elongated rod longitudinally slidably mounted to said handle and movable between an extended position and a retracted position, a toilet cleaning brush attached to one end of said rod, wherein with said rod in said retracted position, said brush is nested within said cup cavity and wherein with said rod in said extended position, said brush protrudes outwardly through said open end of said cup cavity, means for preventing rotation of said brush relative to said handle, wherein said preventing means comprises an actuator button attached to said rod, said actuator button being longitudinally slidably mounted in a longitudinal slot in said handle.

11. A toilet cleaning implement comprising:

a plunger having an elongated handle and a compressible cup attached to one end of said handle, said cup defining a cavity open at one end, an elongated rod longitudinally slidably mounted to said handle and movable between an extended position and a retracted position, a toilet cleaning brush attached to one end of said rod, wherein with said rod in said retracted position, said brush is nested within said cup cavity and wherein with said rod in said extended position, said brush protrudes outwardly through said open end of said cup cavity, wherein said rod is slidably mounted in a longitudinal bore formed in said handle, wherein said handle includes an elongated and longitudinally extending slot open to said bore and comprising an actuator button attached to said rod and slidably mounted in said slot.

12. The implement as defined in claim 11 wherein said actuator button extends outwardly from said slot.

13. The implement as defined in claim 11 wherein said actuator button is fixedly mounted to said rod.

* * * * *